US009808861B2

(12) United States Patent
Schneider et al.

(10) Patent No.: US 9,808,861 B2
(45) Date of Patent: Nov. 7, 2017

(54) PROCESS AND APPARATUS FOR CASTING TITANIUM ALUMINIDE COMPONENTS

(71) Applicant: BorgWarner Inc., Auburn Hills, MI (US)

(72) Inventors: Wolfgang Schneider, Odernheim (DE); Frank Scherrer, Frankenthal (DE)

(73) Assignee: BorgWarner Inc., Auburn Hills, MI (US)

( * ) Notice: Subject to any disclaimer, the term of this patent is extended or adjusted under 35 U.S.C. 154(b) by 19 days.

(21) Appl. No.: 14/787,284

(22) PCT Filed: Apr. 30, 2014

(86) PCT No.: PCT/US2014/036026

§ 371 (c)(1),
(2) Date: Oct. 27, 2015

(87) PCT Pub. No.: WO2015/020704

PCT Pub. Date: Feb. 12, 2015

(65) Prior Publication Data

US 2016/0129499 A1 May 12, 2016

(30) Foreign Application Priority Data

May 8, 2013 (DE) ..... 10 2013 007 958

(51) Int. Cl.
*B22D 18/02* (2006.01)
*B22D 21/00* (2006.01)

(52) U.S. Cl.
CPC ..... *B22D 18/02* (2013.01); *B22D 21/005* (2013.01)

(58) Field of Classification Search
CPC ..... B22D 18/00; B22D 18/02; B22D 18/06; B22D 17/00; B22D 17/14
See application file for complete search history.

(56) References Cited

U.S. PATENT DOCUMENTS 3,823,760 A 7/1974 Bloomfield et al.
4,589,466 A * 5/1986 Chandley ..... B22D 37/00 164/119

(Continued)

FOREIGN PATENT DOCUMENTS

CN 1382542 A 12/2002
CN 101537481 A 9/2009

(Continued)

OTHER PUBLICATIONS

International Search Report and Written Opinion in International Application No. PCT/US2014/036026, dated Feb. 25, 2015.

(Continued)

*Primary Examiner* — Keith Walker
*Assistant Examiner* — Steven Ha
(74) *Attorney, Agent, or Firm* — Eric L. Doyle; Stephan A. Pendorf; Patent Central LLC

(57) ABSTRACT

A process for casting TiAl components, having the following process steps: producing a melt (S) of the TiAl material below an inert gas fill (IF); placing a casting mold (1) on a gate (2) in a gastight manner; flooding the casting mold (1) with inert gas (IG) by opening a closure mechanism (7) which is arranged at the gate (2) and is connected to an inert gas source (8); pressing the melt (S) through the gate (2) into the casting mold (1) by increasing the pressure (P) of the inert gas fill (IF) above the melt (S) while at the same time evacuating the inert gas (IG) from the casting mold (1), and stopping the inflow of inert gas (IG) as soon as it is determined that the melt (S) passes above the position of the closure mechanism (7).

13 Claims, 1 Drawing Sheet

(56) References Cited

U.S. PATENT DOCUMENTS

| | | | | |
|---|---|---|---|---|
| 4,630,666 | A * | 12/1986 | Wismann | A61C 13/20 164/155.2 |
| 5,309,975 | A | 5/1994 | Ohnishi et al. | |
| 2004/0256073 | A1 * | 12/2004 | Kubota | B22D 17/32 164/65 |
| 2010/0108285 | A1 | 5/2010 | Mizuno et al. | |

FOREIGN PATENT DOCUMENTS

| | | | |
|---|---|---|---|
| GB | 1028736 | A | 5/1966 |
| JP | 63273562 | A | 11/1988 |
| JP | 2595534 | B2 | 4/1997 |
| JP | 09122883 | A | 5/1997 |
| JP | 2004174517 | A | 6/2004 |
| JP | 3755172 | B2 | 3/2006 |
| JP | 2011025296 | A | 2/2011 |
| KR | 20100016346 | A | 2/2010 |
| KR | 20110121470 | A | 11/2011 |
| KR | 20120138064 | A | 12/2012 |

OTHER PUBLICATIONS

Supplementary European Search Report dated Oct. 21, 2016, in European Application No. 14834940.

Noda, T "Application of cast gamma TiAl for automobiles" Intermetallics, Elsevier Science Publishers B.V., Great Britain, vol. 6, No. 7-8, Nov. 12, 1998 (Nov. 12, 1998), pp. 709-713, XP004143876, ISSN: 0966-9795, DOI: 10.1016/S0966-9795(98)00060-0 paragraph (04.1), figure 5.

Chinese Office Action (with English language translation) dated Oct. 10, 2016, Chinese Application No. 201480035246.0.

* cited by examiner

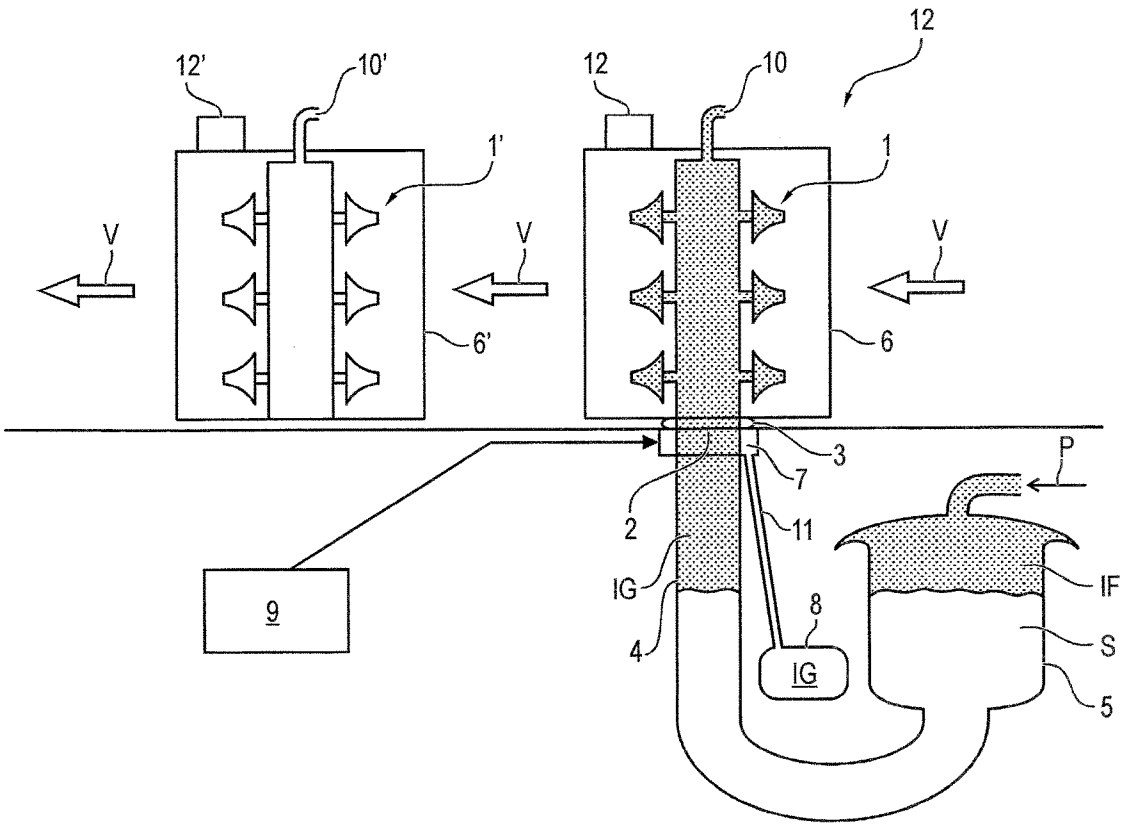
12
10
12
1
V
6
3
7
11
8
IG
P
IF
S
5
2
IG
4
V
1'
6'
10'
12'
9
V

PROCESS AND APPARATUS FOR CASTING TITANIUM ALUMINIDE COMPONENTS

BACKGROUND OF THE INVENTION

Field of the Invention

The invention relates to a process for casting titanium aluminide components.

Description of the Related Art

The processing of titanium aluminide melts gives rise to the problem that this melt has a very high affinity to oxygen. This has the effect that the melt reacts very quickly with atmospheric oxygen and forms defects in the cast part or on the surface thereof. Furthermore, replenishment of the very quickly solidifying melt is possible only to a very limited extent in gravity casting, which has been commonly used to date.

It is therefore an object of the present invention to provide a process and an apparatus for casting titanium aluminide components (TiAl components), which make it possible to produce components without defects in a cost-effective manner.

BRIEF SUMMARY OF THE INVENTION

In accordance with the process according to the invention, a melt of the titanium aluminide material (TiAl material) is produced below an inert gas fill. The casting mold which is to be filled with the molten TiAl material is placed on a gate in a gastight manner from above, such that the casting mold can be filled with the melt from below.

After the casting mold has been placed on the gate, a closure mechanism which is arranged at the gate and is connected to an inert gas source is opened. By conducting inert gas at the closure mechanism into the casting mold and the riser, both are flooded with inert gas. Then, the pressure of the inert gas fill above the melt is increased, such that the melt rises in the riser. If the melt passes above the position of the closure mechanism, the inflow of inert gas is stopped, in order to avoid turbulence in the melt and in order to evacuate the casting mold.

The evacuation can be carried out as the casting mold is being filled with melt. As soon as the casting mold has been filled, which in particular can be detected by the discharge of melt at an evacuation opening, the pressure of the inert gas fill above the melt is reduced and the supply of inert gas at the closure mechanism is restarted, until the fill level of the melt in the riser drops and an inert gas buffer volume can form below the closure mechanism, so that contact between the melt and atmospheric oxygen in the riser is avoided in any case after the closure mechanism has been closed for exchanging the casting mold.

The process according to the invention achieves the advantage that the casting mold can be filled very quickly and the casting mold, which is preferably arranged in exchangeable molding boxes, can be placed above the gate in a gastight manner. The flooding with inert gas and the subsequent evacuation of the casting mold avoid the oxygen contact of the titanium aluminide melt. Controlling the pressure over time makes it possible to completely flood and evacuate the mold in a very short time. The vacuum which arises in the casting mold avoids gas inclusions in the cast part. The casting molds, which are preferably to be arranged in exchangeable molding boxes, allow for short cycle times and therefore cost-effective production.

BRIEF DESCRIPTION OF THE DRAWING

Further details, advantages and features of the present invention become apparent from the following description of an exemplary embodiment with reference to the drawing, in which:

The single FIGURE of the drawing shows a schematically greatly simplified basic illustration of an apparatus 12 according to the invention for casting TiAl components, which is suitable for carrying out the process according to the invention as mentioned in the introduction.

DETAILED DESCRIPTION OF THE INVENTION

The apparatus 12 has a casting mold 1, which, in the particularly preferred embodiment shown in the FIGURE, is arranged in a molding box 6 of exchangeable configuration. In the FIGURE, the double-arrows V denote the feed direction of these molding boxes 6, where a further molding box 6' with a casting mold 1', which has already been filled and accordingly has been advanced in the feed direction V, is arranged to the left alongside the molding box 6 or the casting mold 1 shown in the FIGURE.

In the filling position shown in the FIGURE, the casting mold 1 is placed onto a gate 2 from above in a gastight manner. The gate 2 in turn is provided with a closure mechanism 7, which is controlled by a system monitoring device 9.

The apparatus 12 furthermore has a melting crucible 5, in which the melt S of the TiAl material is produced, the melt S being produced under an inert gas fill IF which is at a pressure P.

The melting crucible 5 is connected to the gate 2 and to the closure mechanism 7 arranged thereon via a riser 4. The closure mechanism 7 is moreover connected via a connection line 11 to an inert gas source or an inert gas vessel 8, from which inert gas IG, which can likewise be kept at an adjustable pressure, is supplied.

The FIGURE shows a state in which the melt S has not yet reached the closure mechanism 7 and the gate 2, and therefore, to avoid contact with air, the melt S is also covered in the riser 4 with inert gas IG, which is also conducted into the casting mold 1 via the closure mechanism 7. The closure mechanism 7 is preferably connected to a system monitoring device 9 for signaling purposes.

To introduce the melt S into the casting mold 1, the pressure P of the inert gas fill IF is increased, such that the melt S passes via the riser 4, the closure mechanism 7 and the gate 2 into the casting mold 7, until the latter has been filled completely, this preferably being determined by an optical detection device 12 on the basis of the discharge of melt from an evacuation opening 10 of the casting mold 1.

The melt S is preferably supplied proceeding from a melting crucible 5, provided with the inert gas fill IF, via a riser 4 to the closure mechanism 7 and the gate 2. The inert gas IG is preferably supplied from a vessel 8 as an inert gas source to the closure mechanism 7 via a connection line 11.

Preferably, the pressure P of the inert gas fill IF is reduced as soon as the casting mold 2 has been filled, with restarting the supply of inert gas IG to the closure mechanism 7 until the fill level of the melt S has reached below the closure mechanism 7. When the filling of the casting mold 2 is detected through a discharge of melt S at an evacuation opening 10 of the casting mold 2, this is preferably detected optically. The process preferably further comprises closing the closure mechanism 7 while maintaining the supply of inert gas IG to the melt S below the gate 2.

It is to be added that a suitable seal 3 is provided at the gate 2 so that the casting mold 1 can be placed on the gate 2 in a gastight manner.

In addition to the above written description of the invention, reference is hereby explicitly made, for additional disclosure thereof, to the diagrammatic illustration thereof in the single FIGURE of the drawing.

LIST OF REFERENCE SIGNS

1 Casting mold
2 Gate
3 Seal
4 Riser
5 Melting crucible
6, 6' Molding box
7 Closure mechanism
8 Inert gas source/Inert gas vessel
9 System monitoring device
10, 10' Evacuation opening
11 Connection line
12, 12' Optical detection device
V Feed direction
IF Inert gas fill above the melt S
IG Inert gas in the riser 4
P Pressure of the inert gas fill IF

The invention claimed is:

1. A process for casting TiAl components, comprising the following process steps:

producing a melt (S) of a TiAl material below an inert gas fill (IF);

placing a casting mold (1) on a gate (2) in a gastight manner;

flooding the casting mold (1) with inert gas (IG) by opening a closure mechanism (7) which is arranged at the gate (2) and is connected to an inert gas source (8);

pressing the melt (S) through the gate (2) into the casting mold (1) by increasing the pressure (P) of the inert gas fill (IF) above the melt (S) while at the same time evacuating the inert gas (IG) from the casting mold (1), and stopping the inflow of inert gas (IG) as soon as it is determined that the melt (S) passes above the position of the closure mechanism (7).

2. The process as claimed in claim 1, comprising reducing the pressure (P) of the inert gas fill (IF) as soon as the casting mold (2) has been filled, and restarting the supply of inert gas (IG) to the closure mechanism (7) until the fill level of the melt (S) has reached below the closure mechanism (7).

3. The process as claimed in claim 2, wherein filling of the casting mold (2) is detected through a discharge of melt (S) at an evacuation opening (10) of the casting mold (2).

4. The process as claimed in claim 3, wherein the filling of the casting mold is detected optically.

5. The process as claimed in claim 2, further comprising closing the closure mechanism (7) while maintaining the supply of inert gas (IG) to the melt (S) below the gate (2).

6. The process as claimed in claim 1, wherein the melt (S) is supplied proceeding from a melting crucible (5), provided with the inert gas fill (IF), via a riser (4) to the closure mechanism (7) and the gate (2).

7. The process as claimed in claim 1, wherein the inert gas (IG) is supplied from a vessel (8) as an inert gas source to the closure mechanism (7) via a connection line (11).

8. The process as claimed in claim 1, wherein the closure mechanism (7) is controlled via a system monitoring device (9).

9. An apparatus (12) for casting TiAl components, comprising a melting crucible (5);

a riser (4), which connects the melting crucible (5) to a gate (2); and a casting mold (1) which can be placed on the top of the gate (2), wherein an openable and closable closure mechanism (7) is arranged at the gate (2), and wherein the closure mechanism (7) is fluidically connected to an inert gas source (8) via a connection line (11).

10. The apparatus as claimed in claim 9, wherein the closure mechanism (7) is connected to a system monitoring device (9) for signaling purposes.

11. The apparatus as claimed in claim 9, wherein the inert gas source (8) is a vessel.

12. The apparatus as claimed in claim 9, wherein provision is made of an optical detection device (12), which monitors an evacuation opening (10) of the casting mold (1).

13. The apparatus as claimed in claim 9, wherein the casting mold (1) is arranged in an exchangeable molding box (6).

* * * * *